US006341823B1

(12) United States Patent
Sollami

(10) Patent No.: US 6,341,823 B1
(45) Date of Patent: Jan. 29, 2002

(54) ROTATABLE CUTTING TOOL WITH NOTCHED RADIAL FINS

(75) Inventor: Jimmie L. Sollami, Herrin, IL (US)

(73) Assignee: The Sollami Company, Carterville, IL (US)

( * ) Notice: Subject to any disclaimer, the term of this patent is extended or adjusted under 35 U.S.C. 154(b) by 0 days.

(21) Appl. No.: 09/576,151

(22) Filed: May 22, 2000

(51) Int. Cl.[7] ..... E21C 35/18
(52) U.S. Cl. ..... 299/110; 299/79.1; 299/101
(58) Field of Search ..... 299/79.1, 101, 299/103, 110, 111

(56) References Cited

U.S. PATENT DOCUMENTS

| | | | |
|---|---|---|---|
| 2,754,100 | A | 7/1956 | Cartlidge |
| 2,783,038 | A | 2/1957 | Tracy |
| 3,361,481 | A | 1/1968 | Maddock |
| 3,476,438 | A | 11/1969 | Bower, Jr. |
| 3,746,396 | A | 7/1973 | Radd |
| 3,801,158 | A | 4/1974 | Radd et al. |
| 3,833,264 | A | 9/1974 | Elders |
| 4,065,185 | A | 12/1977 | Elders |
| 5,131,725 | A | 7/1992 | Rowlett et al. |
| 5,324,098 | A | 6/1994 | Massa |

FOREIGN PATENT DOCUMENTS

| | | | |
|---|---|---|---|
| GB | 2101657 A | | 1/1983 |
| JP | 7-233692 A | * | 9/1995 |
| SU | 825924 | | 9/1979 |

* cited by examiner

*Primary Examiner*—David Bagnell
*Assistant Examiner*—John Kreck
(74) *Attorney, Agent, or Firm*—Pitts & Brittian, P.C.

(57) ABSTRACT

A rotatable cutting tool for earth displacement equipment for maximizing penetration into hard rock during mining, trenching, drilling, or boring operations. The bit penetrator pocket protector for earth displacement equipment includes a body which defines an upper bit end and a lower shank end. The upper bit end defines a bit insert opening configured to detachably accept a penetrator bit tip. The lower shank end is configured to be securable to a penetrator holder that is welded to an implement of earth working equipment such as the chain excavator or a rotatable drum, or the like. A flange, or pocket protector, is defined between the upper and lower ends in order to provide protection for the bit penetrator lower end and a holder in which it is received by minimizing rock and earth fines from contacting and building up between the holder and bit penetrator. Further, the flange acts as a load bearing surface between the bit penetrator and the holder, thereby protecting the lower end of the bit penetrator and the face and bore of the holder. A plurality of fins are defined between the flange and the upper end in order strengthen the integrity of the bit penetrator. The fins allow for a reduced diameter upper end, as compared to the lower end, in order to enhance the cutting of the bit penetrator. In order to allow for a more fluid flow of material from the tip of the bit penetrator and out of the area being excavated, each fin defines a notched portion along the terminal edge thereof.

11 Claims, 2 Drawing Sheets

ROTATABLE CUTTING TOOL WITH NOTCHED RADIAL FINS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of Invention

This invention relates to the field of earth and mining working equipment and specifically to a earth and mining penetrator bit which is configured to penetrate hardened earth, rock and mining materials.

2. Description of the Related Art

Penetrator bits are attached to the chain excavation lines, and/or rotatable drum equipment for excavation of rock, highly compressed earth and mining materials. Conventional penetrator bits are manufactured from hardenable alloy steel and/or tungsten carbide, and are configured for use in penetrating and removing rock and material of the like from an excavation and mining site. The upper end of a conventional penetrator bit defines a conical configuration, a penetrator tip being carried by the distal end thereof. At the lower end of the bit is provided a means for removably attaching it to a holder carried on an implement of earth and mining working equipment such as cutting chain equipment, a rotatable drum, or the like. After repeated use, it is well-known that the penetrator tip wears away and the bit must be replaced due to wear by grinding of rock waste materials generated during boring, drilling, trenching and mining. When penetrating into and removing particularly hard earth or rocks from a bore hole or ditch, the number of bit replacements can be excessive.

In the field of rotary trenching, earth moving construction equipment, and mining, replaceable penetrator bits with carbide tips are utilized. Typically, a penetrator bit holder is welded to a chain attachment or rotatable drum device utilized for trenching, drilling, boring in rock and mining. The penetrator bit holder is configured to retain a penetrator bit therein. When the tip of the penetrator bit is worn down, the bit is removed from the bit holder and replaced with a new penetrator bit.

It is an object of this invention to provide a penetrator bit specifically designed to penetrate hard rock during trenching, drilling, boring and mining operations.

It is another object of the present invention to extend the life of penetrator bits attached to a mining, trenching, drilling, or boring implement of earth working equipment.

It is another object of the present invention to provide a tip insert for a penetrator bit which is configured to maximize penetration into hard rock, drilling, boring, mining or trenching operations, while removing rock waste or other materials from the bore hole or trench.

BRIEF SUMMARY OF THE INVENTION

Other objects and advantages will be accomplished by the present invention which is a rotatable cutting tool configured to maximize penetration into hard rock, coal, and/or any other material during trenching, drilling, mining or boring operations. The rotatable cutting tool of the present invention includes a body which defines an upper bit end and a lower shank end. The upper bit end defines a bit insert opening configured to detachably accept a penetrator bit tip. The lower shank end is configured to be securable to a penetrator holder that is welded to an implement of earth working equipment such as the chain excavator or a rotatable drum, or the like. A flange, or pocket protector, is defined between the upper and lower ends in order to provide protection for the bit penetrator lower end and a holder in which it is received by minimizing rock and earth fines from contacting and building up between the holder and bit penetrator. Further, the flange acts as a load bearing surface between the bit penetrator and the holder, thereby protecting the lower end of the bit penetrator and the face and bore of the holder.

A plurality of fins are defined between the flange and the upper end in order strengthen the integrity of the bit penetrator. The fins allow for a reduced diameter upper end, as compared to the lower end, in order to enhance the cutting of the bit penetrator. In order to allow for a more fluid flow of material from the tip of the bit penetrator and out of the area being excavated, each fin defines a notched portion along the terminal edge thereof.

BRIEF DESCRIPTION OF THE SEVERAL VIEWS OF THE DRAWINGS

The above mentioned features of the invention will become more clearly understood from the following detailed description of the invention read together with the drawings in which.

DETAILED DESCRIPTION OF THE INVENTION

Figure 2:
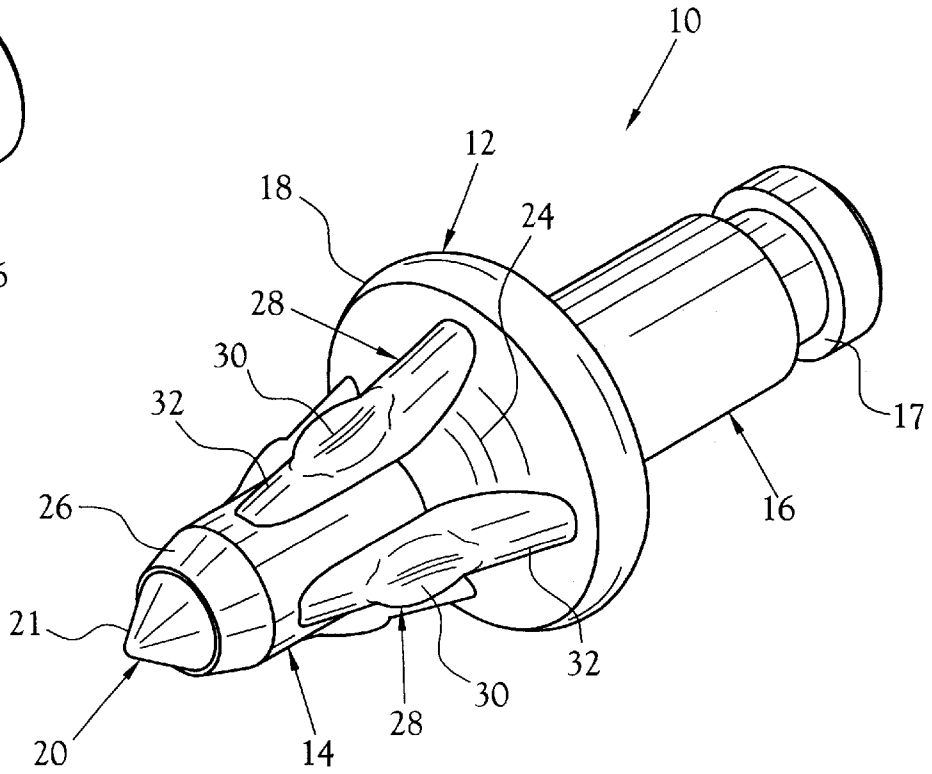
FIG. 2 is a perspective view of the rotatable cutting tool of the present invention.

A rotatable cutting tool for earth displacement equipment incorporating various features of the present invention is illustrated generally at 10 in the figures. The rotatable cutting tool for earth displacement equipment, or cutting tool 10, is designed to penetrate rock and hardened earth more efficiently with a tungsten carbide insert, or insert 20, while extending the life of the insert 20. The insert 20 is insertable into the cutting tool 10, which is attachable to trenching equipment, mining equipment or earth working equipment such as a chain excavator or a rotatable drum or hammer equipment, or the like. In one embodiment, the cutting tool 10 is designed to receive an insert 20 of a configuration to penetrate rock in hardened strata.

The cutting tool 10 of the present invention can be formed by hot or cold forming, casting or machining. In the preferred embodiment, the cutting tool body 12 is fabricated from steel and the insert 20 is fabricated from tungsten carbide. However, it will be understood that other materials of manufacture may be used to accomplish similar results, depending upon the particular use thereof. The cutting tool 10 defines a body 12 including an upper end 14 and a lower end 16. A flange 18 is defined between the upper and lower ends 14,16. The flange 18 serves as a pocket protector as will be described below.

A plurality of fins 28 are defined between the flange 18 and the upper end 14 in order strengthen the integrity of the cutting tool 10. The fins 28 allow for a reduced diameter upper end 14, as compared to the diameter of the lower end 16, in order to enhance the cutting of the cutting tool 10. The fins 28 further serve to reduce the vibration of the cutting tool 10 and therefore tend the life thereof. The terminal edge 32 of each fin 28 extends from a point inside the perimeter of the flange 18 to approximately the distal end of the upper end 14. In the preferred embodiment, as illustrated, the terminal edge 32 does not reach the perimeter of the flange 18. The slope of the terminal edge 32 of the fin 28 is determined largely in part by the diameter of the flange 18, the distance from the perimeter of the mange 18 that the fin 28 terminates, and the length and diameter of the upper end 14. The terminal edge 32 defines a curved surface in the illustrated embodiment. In order to allow for a more fluid flow of material from the tip of the cutting tool 10 and out of and away from the area being excavated, each fin 28 defines a notched portion 30 along the terminal edge 32 thereof. In the illustrated embodiment, the notched portion 30 is defined at an approximate midpoint of the terminal edge 32 of the fin 28. The notched portion 30 also provides a shear point at which the cutting tool 10 is permitted to fail in conditions where the equipment might otherwise sustain damage. This is especially beneficial on smaller machines which are designed to withstand smaller loads, thus allowing the same cutting tool 10 to be used on both large and small equipment.

The lower end 16 of the body 12 defines a shank configured to be received within a holder (not shown). The holder is securable by conventional means such as welding to an implement of earth working equipment. To this extent, the holder defines a through opening configured to loosely receive the lower end 16 of the body 12 in order to allow free rotation of the cutting tool 10 therein.

The flange 18 provides protection for the bit penetrator lower end 16 and the holder in which it is received by minimizing rock and earth fines from contacting and building up between the holder and cutting tool 10. Further, the flange 18 acts as a load bearing surface between the cutting tool 10 and the holder, thereby protecting the lower end 16 of the cutting tool 10 and the face and through opening or bore of the holder. In order to enhance the flow of material from the tip of the cutting tool 10, a curved surface 24 is defined from the extent of the flange 18 to the side wall of the upper end 14, thus eliminating a corner otherwise formed by the flange 18 and the upper end 14.

Figure 1:
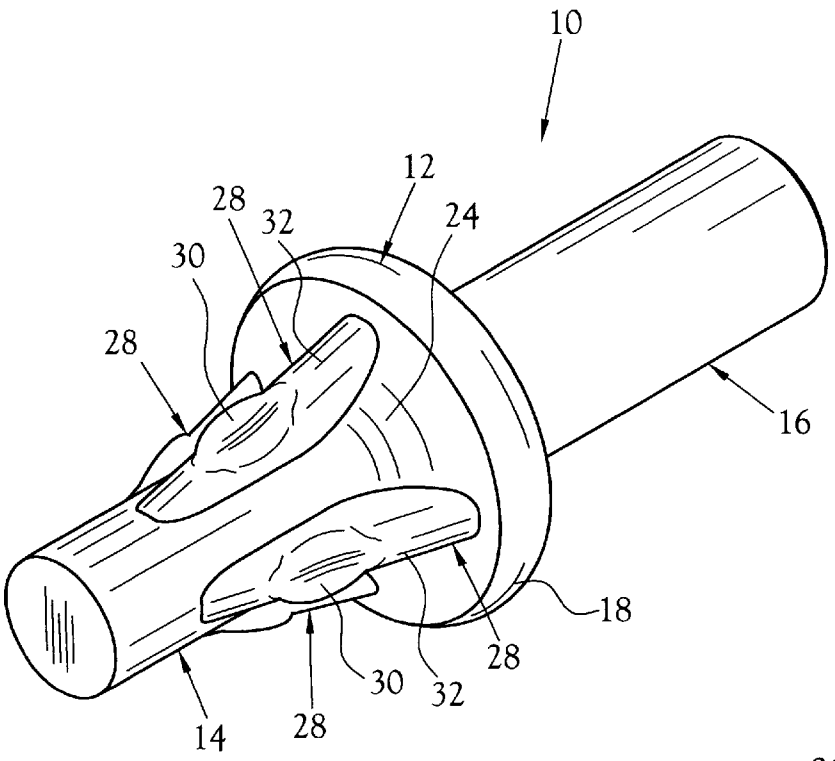
FIG. 1 is a perspective view of a blank for manufacturing a rotatable cutting tool constructed in accordance with several features of the present invention.
Figure 3:
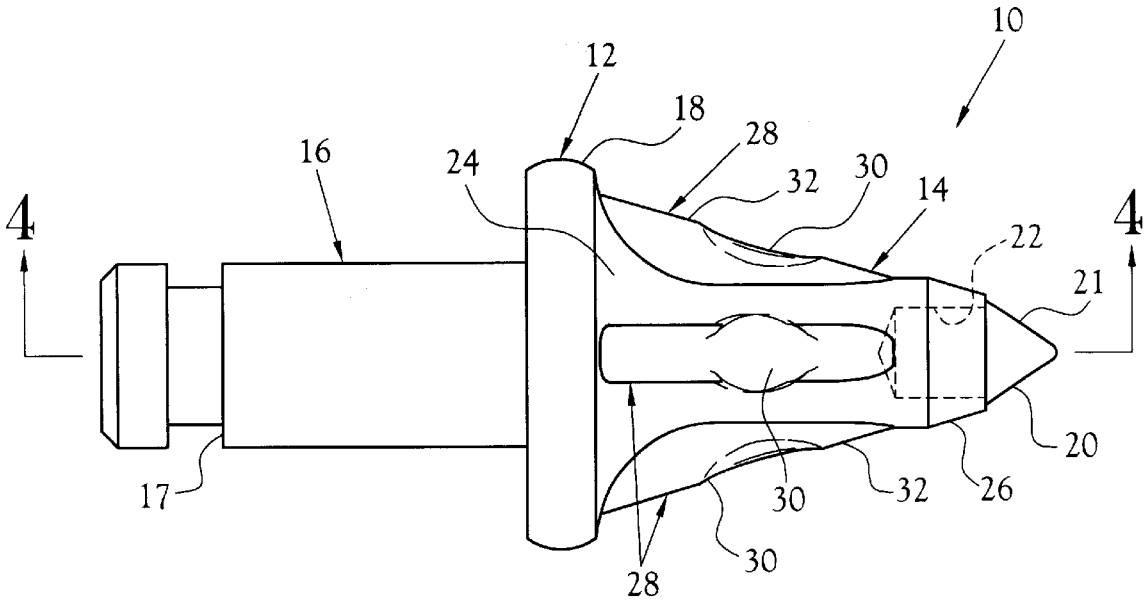
FIG. 3 is a side elevation view of the rotatable cutting tool of the present invention.
Figure 4:
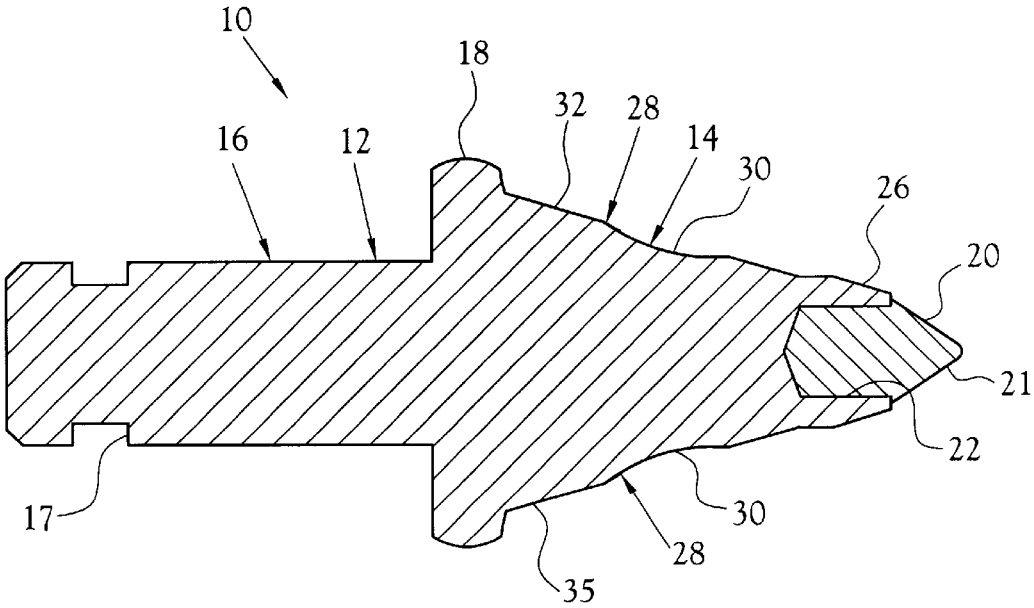
FIG. 4 is an elevation view of the rotatable cutting tool, in section taken at 4—4 of FIG. 3.

Illustrated in FIG. 1 is a cutting tool 10 of the present invention as formed in a conventional manufacturing process. Illustrated in FIG. 2 is a finished cutting tool 10 of the present invention. In order to achieve the cutting tool 10 of the latter figure, after molding the body 12 as shown, the upper end 14 is modified to define an insert receptor 22, for receiving an insert 20, as most clearly illustrated in FIG. 4. The insert receptor 22 is configured to receive and retain an insert 20 of a selected diameter. The distal end of the upper end 14 is also modified to define a chamfered surface 26 from approximately the insert receptor 22 to approximately the terminal edge of the fins 28.

The insert 20 is secured within the receptor 22 by conventional means such as brazing or welding. The insert 20 defines a conical configuration on its distal end, or tip 21. In the preferred embodiment, the insert 20 is fabricated from tungsten carbide or diamond material. It will be understood, although not illustrated, that the insert 20 may be releasably received within the receptor 22 for removal and replacement thereof.

The lower end 16 is also modified to define a radial receptor 17 for receiving a retainer clip (not shown). The radial receptor 17 is disposed a distance from the flange 18 slightly greater than the length of the holder through opening so as not to prevent free rotation of the cutting tool 10. The retainer clip is configured to be closely received within the radial receptor 17 when the bit penetrator lower end 16 is received within the holder through opening. The retainer clip is further configured to define an outer diameter greater than the diameter of the holder through opening, thus serving to prevent extraction of the cutting tool 10 from the holder. It will be understood that other means for removably securing the cutting tool 10 within the holder to allow free rotation of the cutting tool 10 may be incorporated with similar results. For example, a band may be placed on the lower end 16 and received in a recess defined by the holder through opening may be used to retain the cutting tool 10 in the holder.

From the foregoing description, it will be recognized by those skilled in the art that a rotatable cutting tool for earth working equipment offering advantages over the prior art has been provided. Specifically, the cutting tool is designed to penetrate hard rock in hardened strata, and to extend the life of a penetrator bit insert. Further, the cutting tool is configured to receive a penetrator bit insert formed from tungsten carbide or diamond materials. The cutting tool flange provides protection for the lower shank end and the holder in which it is received by minimizing rock and earth fines from contacting and building up between the holder and bit penetrator. Further, the flange acts as a load bearing surface between the bit penetrator and the holder, thereby protecting the lower end of the bit penetrator and the face of the holder. The flange thereby reduces the likelihood of breakage of the cutting tool lower end.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, we claim:

1. A rotatable cutting tool for mounting within a through opening defined within a holder mounted on earth displacement equipment, said rotatable cutting tool comprising:

a body defining:

an upper end defining a distal end;

a lower end being configured to be rotatably received through the holder through opening;

a flange dividing said upper end and said lower end, said flange defining a perimeter having a diameter larger than a diameter defined by said lower end to prevent excavated material from entering the holder through opening, thereby protecting the holder through opening and said body lower end; and a plurality of radial fins circumferentially spaced and disposed on said upper end and said flange, each of said plurality of fins defining a notched portion for allowing flow of excavated material between successive pairs of said plurality of fins, said plurality of fins strengthening said body and reducing vibration of said rotatable cutting tool, whereby a useful life of said rotatable cutting tool is enhanced.

2. The rotatable cutting tool of claim 1 wherein each of said plurality of fins terminates on said flange at a point inside said perimeter thereof.

3. The rotatable cutting tool of claim 1 wherein said upper end distal end defines an insert receptor, said rotatable cutting tool further comprising an insert configured to be received within said insert receptor.

4. The rotatable cutting tool of claim 1 wherein said flange is adapted to cover a face of the holder.

5. A rotatable cutting tool for mounting within a through opening defined within a holder mounted on earth displacement equipment, said rotatable cutting tool comprising:

a body defining:

an upper end defining a distal end;

a lower end being configured to be rotatably received through the holder through opening, said lower end defining a retainer receptor adapted to receive a retainer for preventing removal of said bit penetrator from the holder;

a flange dividing said upper end and said lower end, said flange defining a perimeter having a diameter larger than a diameter defined by said lower end to prevent excavated material from entering the holder through opening, thereby protecting the holder through opening and said body lower end; and a plurality of radial fins circumferentially spaced and disposed on said upper end and said flange, each of said plurality of fins terminating on said flange at a point inside said perimeter thereof, said plurality of fins strengthening said body and reducing vibration of said rotatable cutting tool, whereby a useful life of said rotatable cutting tool is enhanced, each of said plurality of fins defining a notched portion for allowing flow of excavated material between successive pairs of said plurality of fins.

6. The rotatable cutting tool of claim 5 wherein said upper end distal end defines an insert receptor, said rotatable cutting tool further comprising an insert configured to be received within said insert receptor.

7. The rotatable cutting tool of claim 5 wherein said flange is adapted to cover a face of the holder.

8. A method for manufacturing a rotatable cutting tool for mounting within a through opening defined within a holder mounted on earth displacement equipment, said method comprising the steps of:

forming a body to define:

an upper end defining a distal end;

a lower end configured to be rotatably received through the holder through opening;

a flange dividing said upper end and said lower end, said flange defining a diameter larger than a diameter defined by said lower end to prevent excavated material from entering the holder through opening, thereby protecting the holder through opening and said body lower end, said body defining an elongated, cylindrical configuration; and a plurality of radial fins circumferentially spaced and disposed on said upper end and said flange, each of said plurality of fins defining a notched portion for allowing flow of excavated material between successive pairs of said plurality of fins, said plurality of fins strengthening said body and reducing vibration of said rotatable cutting tool, whereby a useful life of said rotatable cutting tool is enhanced;

forming an insert receptor in said upper end distal end for receiving a cutting insert therein; and mounting an insert within said insert receptor.

9. The method of claim 8, after said step of forming a body, further comprising the step of forming a retainer receptor in said lower end.

10. The method of claim 8 wherein said step of forming a body is accomplished using a cold forming process.

11. The method of claim 8 wherein said step of forming a body is accomplished using a hot forming process.

* * * * *

UNITED STATES PATENT AND TRADEMARK OFFICE

CERTIFICATE OF CORRECTION

PATENT NO. : 6,341,823 B1
DATED : January 29, 2002
INVENTOR(S) : Jimmie L. Sollami It is certified that error appears in the above-identified patent and that said Letters Patent is hereby corrected as shown below:

Title page,
Item [73], add the Assignee as:
-- The Sollami Company, Herrin, IL (US) --

Signed and Sealed this

Twenty-fifth Day of February, 2003

JAMES E. ROGAN
*Director of the United States Patent and Trademark Office*